US011326123B1

(12) United States Patent
Adhvaryu et al.

(10) Patent No.: US 11,326,123 B1
(45) Date of Patent: May 10, 2022

(54) DURABLE LUBRICATING FLUIDS FOR ELECTRIC VEHICLES

(71) Applicant: Afton Chemical Corporation, Richmond, VA (US)

(72) Inventors: Atanu Adhvaryu, Glen Allen, VA (US); Christopher Cleveland, Richmond, VA (US); Yungwan Kwak, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/108,596

(22) Filed: Dec. 1, 2020

(51) Int. Cl.

| | |
|---|---|
| ***C10M 135/36*** | (2006.01) |
| ***C10M 169/04*** | (2006.01) |
| ***C10M 137/08*** | (2006.01) |
| ***C10M 141/10*** | (2006.01) |
| *C10N 40/25* | (2006.01) |

(52) U.S. Cl.
CPC ..... *C10M 169/04* (2013.01); *C10M 135/36* (2013.01); *C10M 137/08* (2013.01); *C10M 141/10* (2013.01); *C10M 2203/003* (2013.01); *C10M 2219/106* (2013.01); *C10M 2223/043* (2013.01); *C10N 2040/25* (2013.01)

(58) Field of Classification Search
CPC ..... C10M 169/04; C10M 137/08; C10M 135/36; C10M 141/10; C10M 2223/043; C10M 2203/003; C10M 2219/106; C10N 2040/25
USPC ..... 508/273
See application file for complete search history.

(56) References Cited

U.S. PATENT DOCUMENTS

| | | | |
|---|---|---|---|
| 4,859,352 | A | 8/1989 | Waynick |
| 6,586,374 | B1 | 7/2003 | Paul |
| 6,667,281 | B2 | 12/2003 | Ikejima et al. |
| 6,903,056 | B2 | 6/2005 | Nagano et al. |
| 8,143,202 | B2 | 3/2012 | Peer et al. |
| 8,400,030 | B1 | 3/2013 | Tang et al. |
| 8,563,486 | B2 | 10/2013 | Tsujimoto et al. |
| 8,664,169 | B2 | 3/2014 | Bouffet |
| 8,901,052 | B2 | 12/2014 | Sagawa et al. |
| 8,999,904 | B2 | 4/2015 | Matsui et al. |
| 9,522,972 | B2 | 12/2016 | Visger et al. |
| 9,574,156 | B2 | 2/2017 | Tang et al. |
| 9,598,658 | B2 | 3/2017 | Scanlon et al. |
| 9,896,634 | B2 | 2/2018 | Gao et al. |
| 9,944,877 | B2 | 4/2018 | Gao et al. |
| 2007/0037715 | A1 | 2/2007 | Okada |
| 2008/0194442 | A1 | 8/2008 | Watts |
| 2008/0302422 | A1 | 12/2008 | Neveu et al. |
| 2010/0130390 | A1* | 5/2010 | Tipton ..... C10M 141/10 508/162 |
| 2012/0208731 | A1 | 8/2012 | Lann |

(Continued)

FOREIGN PATENT DOCUMENTS

| | | |
|---|---|---|
| WO | 2014186318 | 11/2014 |
| WO | 2017189277 | 11/2017 |
| WO | 2017210388 | 12/2017 |

*Primary Examiner* — Prem G Singh
*Assistant Examiner* — Francis C Campanell
(74) *Attorney, Agent, or Firm* — Honigman LLP

(57) ABSTRACT

The present disclosure relates to a durable lubricating fluid for an electric motor or hybrid-electric motor. The disclosed technology relates to a durable lubricating fluid comprising an oil of lubricating viscosity, a thiadiazole or derivative thereof, and an amine salt of a phosphoric acid.

17 Claims, 1 Drawing Sheet

(56) References Cited

U.S. PATENT DOCUMENTS

| | | | |
|---|---|---|---|
| 2012/0283159 | A1 | 11/2012 | Matsui et al. |
| 2014/0249061 | A1 | 9/2014 | Youn et al. |
| 2014/0296118 | A1 | 10/2014 | Costello et al. |
| 2015/0322322 | A1 | 11/2015 | Sondjaja et al. |
| 2016/0108337 | A1 | 4/2016 | Abraham et al. |
| 2017/0130161 | A1 | 5/2017 | Vettel et al. |
| 2017/0306259 | A1 | 10/2017 | Ding et al. |
| 2018/0072962 | A1 | 3/2018 | Wada |
| 2018/0079990 | A1 | 3/2018 | Aoyama |
| 2018/0100114 | A1 | 4/2018 | Gao et al. |
| 2018/0100115 | A1 | 4/2018 | Gao et al. |
| 2018/0100117 | A1 | 4/2018 | Flores-Torres et al. |
| 2018/0100118 | A1 | 4/2018 | Flores-Torres et al. |
| 2018/0100119 | A1 | 4/2018 | Aoyama |
| 2018/0134983 | A1 | 5/2018 | Broutin et al. |
| 2018/0327687 | A1 | 11/2018 | Kwak |
| 2019/0002785 | A1 | 1/2019 | Sanson |
| 2019/0002790 | A1 | 1/2019 | Sanson |
| 2019/0112541 | A1 | 4/2019 | Hamachi |
| 2019/0367830 | A1 | 12/2019 | Iwai |
| 2020/0248095 | A1 | 8/2020 | Guerin |
| 2020/0277542 | A1 | 9/2020 | Salvi |

* cited by examiner

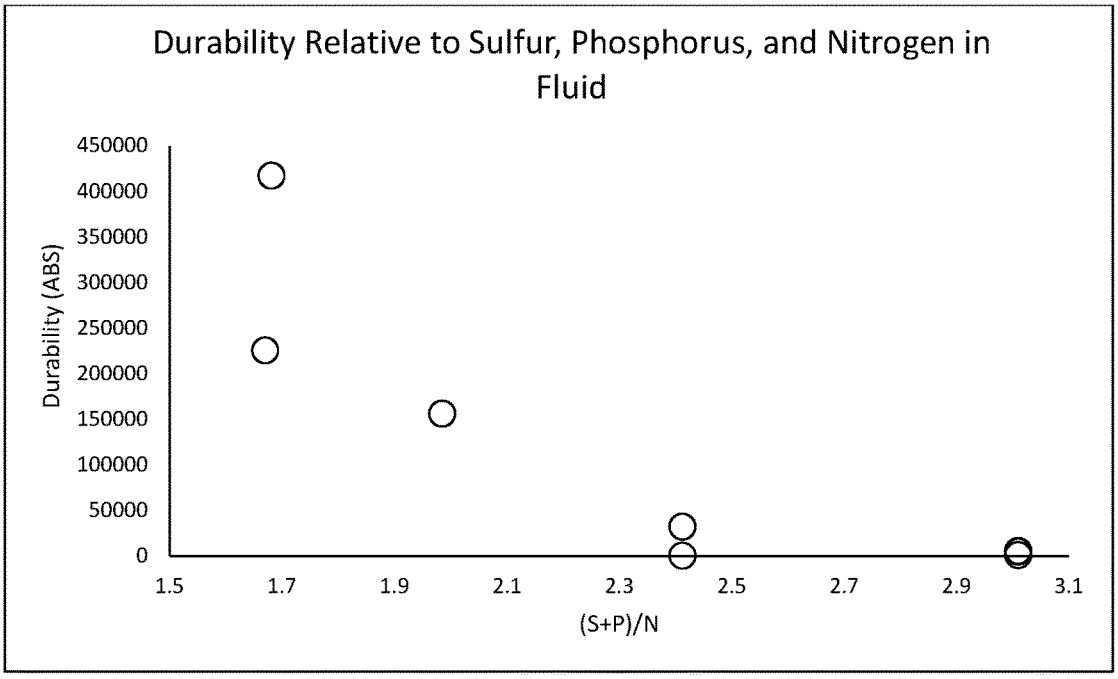
Durability Relative to Sulfur, Phosphorus, and Nitrogen in Fluid
Durability (ABS)
450000
400000
350000
300000
250000
200000
150000
100000
50000
0
1.5
1.7
1.9
2.1
2.3
2.5
2.7
2.9
3.1
(S+P)/N

DURABLE LUBRICATING FLUIDS FOR ELECTRIC VEHICLES

FIELD

The present disclosure relates to a durable lubricating fluid for an electric motor or hybrid-electric motor. The disclosed technology relates to a durable lubricating fluid comprising an oil of lubricating viscosity, a thiadiazole or derivative thereof, an amine salt of a phosphoric acid ester, and having a sulfur plus phosphorus to nitrogen ((S+P)/N)) weight ratio of at least 2.3. Such lubricants have an electrical conductivity durability of 50,000 pS/m.

BACKGROUND

A major challenge in developing electric motor or hybrid-electric motor lubricants is developing a lubricant that maintains a relatively low electrical conductivity even after aging. These types of lubricants should maintain relatively low electrical conductivity (or conversely relatively high electrical resistivity) over the lifetime of the lubricant to inhibit electrostatic buildup and discharge in electrified components found in the electric or hybrid-electric motor.

Lubricating fluids for conventional internal combustion engines commonly employ additives to provide sufficient amounts of sulfur and phosphorus to deliver wear and extreme-pressure protection to mechanical components. However, such additives in lubricating fluids for electric motor or hybrid-electric motors may pose problems because active sulfur and phosphorus compounds are often chemically aggressive to copper wire and copper-based alloys used in electric and or hybrid-electric motors. In addition, sulfur and phosphorus compounds are often conductive, and the inclusion of active sulfur and phosphorus compounds in a lubricant can lead to undesirable increase in the lubricant's electrical conductivity. Thus, lubricating fluids for electric and hybrid-electric motors have the added challenge of maintaining a relatively low electrical conductivity while still protecting copper components and delivering sufficient protection for mechanical components.

SUMMARY AND TERMS

In one aspect or embodiment, a durable lubricating composition for electric or hybrid-electric vehicles is described herein. In embodiments, the lubricating composition includes a base oil of lubricating viscosity; at least about 0.7 weight percent of a thiadiazole or derivative thereof, an amine salt of a phosphoric acid ester providing at least about 100 ppm of phosphorus to the durable lubricating composition; a sulfur plus phosphorus to nitrogen ((S+P)/N) weight ratio of at least 2.3; the lubricating composition having at least about 150 ppm of phosphorus and at least about 2000 ppm of sulfur; and a conductivity durability of about 50,000 pS/m or less. The conductivity durability is defined as the difference between an initial conductivity and a final conductivity, wherein the initial and final conductivities are measured according to ATSM D2624-15 at 1.5 volts, 20 Hz, and at 160 C, and wherein the final conductivity is measured after the lubricating composition has been aged according to CEC L-48-A-00 at 170° C. for 192 hours.

In other aspects or embodiments, the thiadiazole of the durable lubricating composition may be selected from a mono hydrocarbyl thiol-substituted thiadiazole, a bishydrocarbyl thiol-substituted thiadiazole, or combinations thereof; and/or wherein the thiadiazole is 1,3,4-thiadiazole or derivative thereof, and/or wherein the thiadiazole provides at least about 2000 ppm sulfur to the durable lubricating composition; and/or wherein the lubricating composition includes about greater than 0.5 wt % to about 1 wt % of the thiadiazole or derivative thereof, and/or wherein the thiadiazole or derivative thereof includes one or more compounds having a structure of Formula I:

(Formula I)

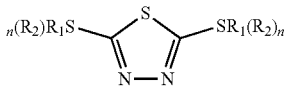

wherein each $R_1$ is independently hydrogen or sulfur; each $R_2$ is independently an alkyl group; n is an integer of 0 or 1 and if $R_1$ is hydrogen then the integer n of the adjacent $R_2$ moiety is 0 and if $R_1$ is sulfur then the n of the adjacent $R_2$ moiety is 1; and wherein at least one $R_1$ is sulfur; and/or wherein the thiadiazole or derivative thereof provides at least about 99 weight % of the sulfur to the durable lubricating composition.

In other aspects or embodiments, the durable lubricating composition of any embodiment herein may include up to about 3500 ppm total sulfur and up to about 300 ppm total phosphorus.

In further aspects or embodiments, the amine salt of a phosphoric acid ester of any embodiment herein includes one or more of a monoalkyl phosphoric acid ester and/or a dialkyl phosphoric acid esters and wherein the alkyl groups thereof may be linear or branched; and/or wherein the amine salt of a phosphoric acid ester is represented by Formula II (Formula II)

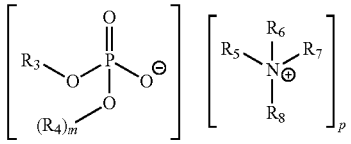

wherein $R_3$ and $R_4$ may be independently hydrogen or a linear, branched, or cyclic hydrocarbyl group; m is an integer from 0 to 1, p is an integer from 1 to 2, and m+p equals 2; $R_5$, $R_6$, $R_7$ and $R_8$ may be independently hydrogen or a hydrocarbyl group and at least one of $R_5$ to $R_8$ is a hydrocarbyl group; and/or wherein $R_3$ and $R_4$ may independently be a C3 to C10 alkyl group; and/or wherein $R_3$ and $R_4$ are a C6 alkyl group; and/or wherein at least one of $R_5$, $R_6$, $R_7$ and $R_8$ is C10 to C20 alkyl group; and/or wherein two of $R_5$, $R_6$, $R_7$ and $R_8$ are independently a C10 to C20 alkyl group; and/or wherein two of $R_5$, $R_6$, $R_7$ and $R_8$ are independently a C12 to C14 alkyl group; and/or wherein the amine salt of a phosphoric acid ester provides about 40 to about 90 weight % of the total phosphorus in the durable lubricating composition; and/or wherein the lubricating composition includes about 0.25 to about 0.5 weight percent of the amine salt of a phosphoric acid ester.

In other aspects or embodiments, the durable lubricating composition of any embodiment may have an initial conductivity of about 150,000 pS/m or less when measured or less as measured according to ASTM D2624-15 at 160 C.

In yet other aspects or embodiments, the present disclosure provides for the use of a durable lubricating composition (or a method of lubricating) in an electric or hybrid electric motor wherein the durable lubricating composition includes a base oil of lubricating viscosity, at least about 0.7 weight percent of a thiadiazole or derivative thereof, an amine salt of a phosphoric acid ester providing at least about 100 ppm of phosphorus to the durable lubricating composition, a sulfur plus phosphorus to nitrogen ((S+P)/N) weight ratio of at least 2.3; the the lubricating composition having at least about 150 ppm of phosphorus and at least about 2000 ppm of sulfur and a conductivity durability of about 50,000 pS/m or less. The conductivity durability is defined as the difference between an initial conductivity and a final conductivity, wherein the initial and final conductivities are measured according to ASTM D2624-15 at 1.5 volts, 20 Hz, and at 160 C, and wherein the final conductivity is measured after the lubricating composition has been aged according CEC L-48-A-00 at 170° C. for 192 hours. The use or methods herein may also include any of the optional features of any embodiment as described in this Summary.

Other embodiments of the present disclosure will be apparent to those skilled in the art from consideration of the specification and practice of the invention disclosed herein.

The following definitions of terms are provided in order to clarify the meanings of certain terms as used herein.

The terms "lubricating oil," "lubricant composition," "lubricating composition," "lubricant" and "lubricating and cooling fluid" refer to a finished lubrication product comprising a major amount of a base oil plus a minor amount of an additive composition.

As used herein, the terms "additive package," "additive concentrate," "additive composition," and "transmission fluid additive package" refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties of from about 1 to about 200 carbon atoms.

The term "alkenyl" as employed herein refers to straight, branched, cyclic, and/or substituted unsaturated chain moieties of from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "number average molecular weight" or "Mn" is determined by gel permeation chromatography (GPC) using commercially available polystyrene standards (with a Mn of 180 to about 18,000 as the calibration reference). The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DESCRIPTION OF DRAWINGS

FIG. 1 is a chart of conductivity durability relative to sulfur, phosphorus, and nitrogen levels.

DETAILED DESCRIPTION

Disclosed herein are durable lubricating fluids suitable for use in electric or hybrid electric vehicles. The durable lubricating fluids contain sulfur and phosphorus for provide wear protection but are delivered in a manner that unexpectly maintains such relatively low conductivity upon lubricant aging.

In one aspect or embodiment, the durable lubricating fluids herein include a base oil of lubricating viscosity, at least about 0.7 weight percent of a thiadiazole or derivative thereof providing sulfur and nitrogen to the fluid and an amine salt of a phosphoric acid ester providing phosphorus and nitrogen to the fluid. The fluids also have a sulfur plus phosphorus to nitrogen ((S+P)/N) weight ratio of at least 2.3 and have at least about 150 ppm of phosphorus and at least about 2000 ppm of sulfur. When the fluid includes at least these additives and ratio between the provided sulfur, phosphorus, and nitrogen, the fluid exhibits a conductivity durability (as described in more detail herein), of about 50,000 pS/m or less. In other aspects or embodiments, the fluids herein may also contain other sources of phosphorus, nitrogen, and/or sulfur as long as the fluids include the noted thiadiazole or derivative thereof and phosphoric acid amine salt additives and the above specified ratio of sulfur, phosphorus, and nitrogen.

In other approaches, the phosphorus content of the fluid may be up to 300 ppm, up to 290 ppm, up to 270 ppm, up to 260 ppm, up to 250 ppm, up to 240 ppm, up to 230 ppm, up to 220 ppm, up to 200 ppm, up to 190, or up to 180. The fluids may also include at least 150 ppm of total phosphorus, or between 150 ppm and 300 ppm of phosphours, or between 180 and 300 ppm of phosphorus or any range therebetween. At least a portion of the phosphorus is provided by the phosphoric acid amine salt additives described herein.

In other approaches, the sulfur content of the fluid may be up to 5000 ppm, up to 4500 ppm, up to 4000 ppm, up to 3500 ppm, up to 3000 ppm, or up to 2600 ppm. The fluids may also include at least about 2000 ppm of sulfur or amounts of sulfur from about 2000 ppm to 5000 ppm or any range therebetween. At least a portion of the sulfur and, in some approaches, the majority of the sulfur is provided by the thiadiazole or derivative thereof as described herein. In some approaches, the thiadiazole or derivatives thereof as described herein may provide at least about 98 percent of the total sulfur to the fluids.

As discussed more below, embodiments of the fluids herein with base oils and at least the thiadiazole or derivative thereof and the amine salt of a phosphoric acid ester additive generally have a kinematic viscosity from 4.5 cSt to 6.0 cSt at 100° C. and exhibit an initial conductivity of about 150,000 pS/m or less as measured according to ASTM D2624-15 (using an Epsilon+electrical conductivity meter from Flucon Fluid Control GmbH or equivalent meter at 1.5 volts, 20 Hz and at 160° C.) and a conductivity durability (absolute value and discussed in more detail below) of less than about 50,000 pS/m after the fluid has been aged according to CEC L-48-A-00 170C for 192 hours. In the context of fluids for electric motors or hybrid-electric motors, fluids with relatively low conductivity (i.e., higher resistivity) and those with the smallest change in conductivity upon aging (that is, durability) are desired.

Base Oil:

Base oils or base oils of lubricating viscosity suitable for use in formulating the durable lubricating fluids for use in electric and hybrid electric motor vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types.

Oils derived from coal or shale may also be suitable. Further, oil derived from a Fischer-Tropsch gas-to-liquid process is also suitable. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). The base oil may have a kinematic viscosity at 100° C. of 2 to 15 cSt, as measured by ASTM D2270-10 (2016).

The base oil as used in the fluids described herein may be a single base oil or may be a mixture of two or more base oils. The one or more base oil(s) may be selected from any of the base oils in Groups II to V as specified in the American Petroleum Institute (API) Base Oil Interchangeability Guidelines. Such base oil groups are shown in Table 1 as follows:

TABLE 1

| Base Oils | | | | |
|---|---|---|---|---|
| Base oil Category | Sulfur (%) | | Saturates (%) | Viscosity Index |
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

In one variation, in any of the embodiments herein, the base oil may be selected from a Group II to Group V base oil, or a mixture of these base oils. In one embodiment, the base oil includes a Group III base oil or a blend of Group III base oils with Group II, Group IV, and/or Group V base oils.

API Group III base oils may include oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. No. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

Group V base oils include synthetic and natural ester base fluids. Synthetic esters may comprise esters of dicarboxylic acids with monohydric alcohols. Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, and the 2-ethylhexyl diester of linoleic acid dimer. Other synthetic esters include those made from $C_5$ to $C_{12}$ monocarboxylic acids and polyols and polyol ethers such as neopentyl glycol, trimethylolpropane, pentaerythritol, dipentaerythritol, and tripentaerythritol. Esters can also be monoesters of mono-carboxylic acids and monohydric alcohols.

Natural esters refer to materials derived from a renewable biological resource, organism, or entity, distinct from materials derived from petroleum or equivalent raw materials. Natural esters include fatty acid triglycerides, hydrolyzed or partially hydrolyzed triglycerides, or transesterified triglyceride esters, such as fatty acid methyl ester (or FAME). Suitable triglycerides include, but are not limited to, palm oil, soybean oil, sunflower oil, rapeseed oil, olive oil, linseed oil, and related materials.

The base oil(s) may be combined with a select sulfur and phosphorus providing additives as well as other optional additives as disclosed in embodiments herein to provide a lubricating fluid for use in an electric motor vehicle. Accordingly, the base oil may be present in the lubricating fluid in an amount greater than about 80 wt %, or about 90 wt % or greater based on the total weight of the lubricating fluid. In some embodiments, the base oil may be present in the lubricating fluid in an amount greater than about 95 wt % based on the total weight of the lubricating fluid.

Thiadiazole Additive:

The durable lubricating compositions herein include a thiadiazole or derivative thereof in an amount of about 0.7 wt % or higher. In some approaches, about 0.7 wt % to about 1 wt %, or about 0.7 wt % to about 0.9 wt % of the thiadiazole or derivative thereof is present in the durable lubricating composition. In some embodiments, the thiadiazole or derivative thereof is a mixture of thiadiazole compounds and/or hydrocarbyl-substituted derivatives thereof.

In some approaches, the thiadiazole or derivative thereof provides at least about 2000 ppm sulfur to the durable lubricating composition, in other approaches, at least about 2200 ppm sulfur, at least about 2400 ppm sulfur, at least about 2600 ppm sulfur, at least about 2800 ppm sulfur, or at least about 2900 ppm sulfur. In other approaches, the thiadiazole or derivative thereof may also provide about 3500 ppm or less sulfur to the durable lubricating composition, and in other approaches, about 3150 ppm or less sulfur.

Surprisingly, the form and amounts of the thiadiazole or derivatives thereof contribute to the electrical conductivity durability of the lubricating compositions while also providing sulfur to provide wear performance characteristics. In approaches, the thiadiazole or derivative thereof includes one or more compounds having a structure of Formula I:

(Formula I)

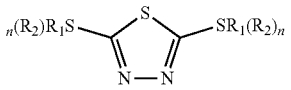

wherein each $R_1$ is independently hydrogen or sulfur, each $R_2$ is independently an alkyl group, n is an integer of 0 or 1 and if $R_1$ is hydrogen then the integer n of the adjacent $R_2$ moiety is 0 and if $R_1$ is sulfur then the n of the adjacent $R_2$ moiety is 1, and with the proviso that at least one $R_1$ is sulfur. In other approaches, the thiadiazole additive is a blend of compounds of Formula Ia and Formula Ib shown below:

(Formula Ia)

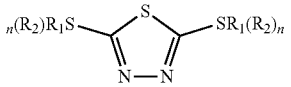

wherein within Formula Ia each integer n is 1, each $R_1$ is sulfur, and each $R_2$ is a C5 to C15 alkyl group, preferably a C8 to C12 alkyl group; and (Formula Ib)

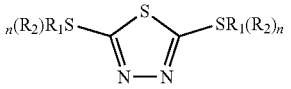

wherein within Formula Ib one integer n is 1 with the associated $R_2$ group being a C5 to C15 alkyl group (preferably a C8 to C12 alkyl group) and the associated $R_1$ group being sulfur and the other integer n is 0 with the associated $R_1$ group being hydrogen. In some embodiments, the thiadiazole or derivative thereof includes a blend of Formula Ia and Ib with Formula Ia being a majority of the blend and in other approaches, the blend of Ia and Ib is about 75 to about 90 weight percent of Ia and about 10 to about 25 weight percent of Ib (or other ranges therewithin). In another approach, the thiadiazole is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%). In other approaches or embodiments, examples of the thiadiazole compounds that may be used in the fluids herein include 2-mercapto-5-hydrocarbylthio-1,3,4-thiadiazole; 2-mercapto-5-hydrocarbyldithio-1,3,4-thiadiazole; 2,5-bis (hydrocarbylthio)-1,3,4-thiadiazole; 2,5-bis(hydrocarbyldithio)-1,3,4-thiadiazoles, variations thereof, or combinations thereof. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

In yet other approaches, the thiadiazole or derivatives thereof may also provide the majority of sulfur to the durable lubricating compositions herein. In some approaches, the select thiadiazole or derivatives herein may provide at least about 98 wt % of the total sulfur, or at least about 99 wt % percent of the total sulfur in the lubricating compositions. As discussed more below, the compositions herein also have select relationships of the sulfur and phosphorus relative to nitrogen to achieve robust electrical conductivity durability performance.

In approaches or embodiments, the fluids herein include at least about 0.7 weight percent of the thiadiazole or derivative thereof, at least about 0.8 weight percent, or at least about 0.85 weight percent, and, in some embodiments, less than about 1 weight percent, less than about 0.95 weight percent, or less than about 0.9 weight percent of the thiadiazole or derivative thereof.

Phosphorus Additive:

The durable lubricating compositions herein also include a phosphorus additive in an amount of about 0.25 wt % to about 0.5 wt %. In approaches or embodiments, the select phosphorus additive is an amine salt of a phosphoric acid ester in an amount providing at least about 100 ppm of phosphorus to the durable lubricating composition (in other approaches, about 130 ppm phosphorus to about 160 ppm phosphorus to the lubricating compositions herein). The amine salt of a phosphoric acid ester may include one or more monoalkyl phosphoric acid esters, dialkyl phosphoric acid esters, and/or mixtures thereof wherein the alkyl groups thereof may be linear, branched, or cyclic. The fluids herein may also include other compounds providing phosphorus, but in some embodiments, the amine salt of a phosphoric acid ester herein provides about 40 to about 90 weight % of the total phosphorus in the durable lubricating composition (in other embodiments, about 50 to about 80 weight percent of the phosphorus, or about 50 to about 70 weight percent of the phosphorus in the lubricating compositions herein).

In approaches or embodiments, the amine salt of a phosphoric acid ester may be represented by Formula II (Formula II)

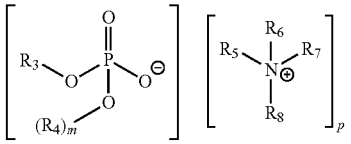

wherein $R_3$ and $R_4$ may be independently hydrogen or a linear, branched, or cyclic hydrocarbyl group; m is an integer from 0 to 1, p is an integer from 1 to 2, and m+p equals 2; $R_5$, $R_6$, $R_7$ and $R_8$ may be independently hydrogen or a hydrocarbyl group and at least one of $R_5$ to $R_8$ is a hydrocarbyl group. Examples of a suitable alkyl or hydrocarbyl group for $R_3$ and/or $R_4$ include straight-chain or branched alkyl groups such as, but not limited to, propyl, butyl, pentyl, hexyl, heptyl, octyl, nonyl, and/or decyl groups. In yet further exemplary approaches, $R_3$ and $R_4$ may be a cyclic hydrocarbyl group and examples include cyclopentyl, cyclohexyl, cycloheptyl, methylcyclopentyl, dimethyl cyclopentyl, methylcyclopentyl, dimethyl cyclopentyl, methylethylcyclopentyl, diethylcyclo-pentyl, methylcyclohexyl, dimethylcyclohexyl, methylethylcyclohexyl, diethylcyclohexyl, methylcycloheptyl, dimethylcycloheptyl, methylethyl-cycloheptyl, and/or diethylcycloheptyl. In some approaches or embodiments, suitable amine salts of a phosphoric acid ester is a mixture of monoalkyl and dialkyl phosphoric acid esters. The monoalkyl and dialkyl groups may be linear, branched, or cyclic as noted above.

The amine salt of a phosphoric acid ester is known to those of skill and may be derived from a primary, secondary, or tertiary amine, or mixtures thereof. Exemplary amines suitable for the salt may be aliphatic, cyclic, aromatic or non-aromatic, but commonly is an aliphatic amine. Examples of suitable primary amines include ethylamine, propylamine, butylamine, 2-ethylhexylamine, bis-(2-ethylhexyl)amine, octylamine, and dodecyl-amine, and fatty amines such as n-octylamine, n-decylamine, n-dodecylamine, n-tetradecylamine, n-hexadecylamine, n-octadecylamine or oleyamine. Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclo-hexane, and/or ethylamylamine. The secondary amines may also be cyclic amines such as piperidine, piperazine and morpholine. Examples of suitable tertiary amines may include tri-n-butylamine, tri-n-octylamine, tri-decylamine, tri-laurylamine, tri-hexadecylamine, and/or dimethyl-oleylamine.

In some approaches, the amine of Formula II above may have at least one of the $R_5$, $R_6$, $R_7$ or $R_8$ groups being a C10 to C20 alkyl group, and in other approaches or embodiments, at least two of the $R_5$, $R_6$, $R_7$ or $R_8$ groups are independently a C10 to C20 alkyl group. In some embodiments, at least two of the $R_5$, $R_6$, $R_7$ or $R_8$ groups are independently a C12 to C14 alkyl group.

The amine salt of a phosphoric acid ester may be as described in U.S. Pat. No. 9,574,156, which is incorporated herein by reference, and may be prepared by reacting suitable phosphorus compounds with an amine to form the amine salt of a phosphoric acid ester. In one embodiment, the amine salt of a phosphoric acid ester may be of Formula (II) wherein $R_3$ and $R_4$ may be independently C6 or hydrogen; m is an integer from 0 to 1, p is an integer from 1 to 2, and m+p equals 2; $R_5$, $R_6$, $R_7$ and $R_8$ may be independently hydrogen or a hydrocarbyl group of C12-C14 and at least one of $R_5$ to $R_8$ is a hydrocarbyl group of C12-C14. In approaches, the amine salt of a phosphoric acid ester may be present in the durable lubricating fluids herein in amounts of at least about 0.25 weight percent, or at least about 0.3 weight percent, or up to about 0.5 weight percent, or up to about 0.35 weight percent of the lubricating composition.

Lubricant Composition:

The durable lubricating compositions herein include a majority of a base oil of lubricating viscosity, the thiadiazole or derivative thereof providing sulfur and nitrogen to the fluid, and the amine salt of a phosphoric acid ester providing phosphorus and nitrogen to the fluid. The lubricating compositions may include other additives as needed. Even though sulfur and phosphorus can be problematic for maintain relatively low conductivity in fluids for electric or hybrid-electric motors, it was discovered if the phosphorus and sulfur are provided by at least these additives and the fluid also includes levels of phosphorus, sulfur, and nitrogen provided in a select weight ratio of sulfur plus phosphorus to nitrogen (S+P)/N of at least about 2.3, then the fluid is surprisingly exhibits a small change in electrical conductivity after aging. For example, the fluids have initial relatively low electrical conductivity when measured according to ASTM D2624-15 at 1.5 volts, 20 Hz, and at 160 C. The electrical conductivity of the fluids is again measured according to the same procedure but after the after the fluids are aged. The aging process is according to CEC L-48-A-00 at 170° C. for 192 hours. The change in conductivity between the initial conductivity measurement and the conductivity measurement after aging is about 50,000 pS/m or less. Thus, these fluids maintain their relatively low electrical conductivity properties even after aging and are deemed to be durable lubricating compositions. In other embodiments, the select weight ratio to achieve fluid durability is at least about 2.4, at least about 2.7, or at least about 2.9 and, preferably, less than 4.0, less than 3.5, less than 3.3, less than 3.1, or less than 3.0.

In embodiments, the fluids herein may also exhibit an initial conductivity of about 140,000 pS/m or less or about 70,000 pS/m or less and, in some approaches, about 50,000 pS/m or more or about 60,000 pS/m or more. In other embodiments, the fluids also exhibit an electrical conductivity durability (measured as the difference between initial conductivity and conductivity after aging as described above) of 50,000 pS/m or less, about 40,000 pS/m or less, about 30,000 pS/m or less, about 20,000 pS/m or less, about 10,000 pS/m or less, about 5,000 pS/m or less, or even about 2,000 pS/m or less.

Other Additives: The lubricating fluids described herein may also include one or more further additives. For instance, the fluid may include at least one component selected from the group, comprising, an antioxidant, a friction modifier, a detergent, a corrosion inhibitor, a copper corrosion inhibitor, an antifoam agent, a seal-swell agent, an extreme pressure agent, an anti-wear agent, a viscosity modifier, a dispersant, and combinations thereof. Other performance additives may also include, in addition to those specified above, one or more of metal deactivators, demulsifiers, pour point depressants, and mixtures thereof.

Antioxidants: In some embodiments, the lubricating fluid contains one or more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol). N,N'-di-sec-butyl-phenylenediamine, 4-isopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

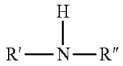

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating fluid described herein may be present in an amount to deliver up to 200 ppm nitrogen, or up to 175 ppm nitrogen, or between 150 to 200 ppm nitrogen.

Friction Modifiers: Suitable additional friction modifiers may comprise metal containing and metal-free friction modifiers and may include, but are not limited to, imidazolines, aliphatic fatty acid amides, aliphatic amines, succinimides, alkoxylated aliphatic amines, ether amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

If the additional friction modifiers contain nitrogen, such additional friction modifiers may be present in the lubricating fluid in an amount to deliver up to 200 ppm nitrogen, or up to 150 ppm nitrogen, or between 100 to 150 ppm nitrogen.

Detergents: Metal detergents that may be included in the lubricating fluid described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the lubricating fluid in an amount sufficient to improve the anti-rust performance of the fluid. The metal-containing detergent may be present in the fluid in an amount sufficient to provide up to 200 ppm alkali and/or alkaline earth metal based on a total weight of the lubricating fluid. In one example, the metal-containing detergent may be present in an amount sufficient to provide from 100 to 200 ppm alkali and/or alkaline earth metal. In another embodiment, the metal-containing detergent may be present in an amount sufficient to provide from 100 to 150 ppm alkali and/or alkaline earth metal.

Corrosion Inhibitors: Rust or corrosion inhibitors may also be included in the lubricating compositions described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Suitable copper corrosion inhibitors include ether amines, polyethoxylated compounds such as ethoxylated amines and ethoxylated alcohols, imidazolines, monoalkyl and dialkyl thiadiazole, and the like. Additional compounds include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Thiazoles and triazoles may also be used in the lubricants. Examples include benzotriazole; tolyltriazole; octyltriazole; decyltriazole; dodecyltriazole; and 2-mercaptobenzotriiazole Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines, acid phosphates, amines, polyethoxylated compounds such as ethoxylated amines, ethoxylated phenols, and ethoxylated alcohols, imidazolines, aminosuccinic acids or derivatives thereof, and the like.

Mixtures of such rust or corrosion inhibitors may be used. The total amount of corrosion inhibitor, when present in the lubricating composition described herein may range up to 1.0 wt % or from 0.01 to 0.5 wt % based on the total weight of the lubricating composition.

Extreme Pressure Agents: The lubricating fluid described herein may optionally include one or more extreme pressure (EP) agents. EP agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Anti-Wear Agents: The lubricating oil compositions herein also may optionally contain one or more additional anti-wear agents. Examples of suitable antiwear agents include, but are not limited to, a phosphoric acid ester or salt thereof, a phosphate ester(s); a phosphite; a phosphonate, a phosphorus-containing carboxylic ester, ether, or amide; oil soluble amine salts of phosphorus compounds, a sulfurized olefin; thiocarbamate-containing compounds including, thiocarbamate esters, alkylene-coupled thiocarbamates, and bis(S-alkyldithio carbamyl) disulfides; and mixtures thereof.

The antiwear agent may be present in ranges including about 0 wt % to about 1 wt %, in other approaches, about 0.01 wt % to about 0.8 wt %, in yet other approaches, about 0.05 wt % to about 0.5 wt %, or, in further approaches, about 0.1 wt % to about 0.3 wt % of the lubricating oil composition.

Viscosity Modifiers: The lubricating fluid may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The lubricating fluid described herein also may optionally contain one or more dispersant viscosity modifiers in addition to a viscosity modifier or in lieu of a viscosity modifier.

Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to 1.0 wt %, or up to 0.5 wt %, or up to 0.3 wt % based on the total weight of the lubricating fluid.

Dispersants: The lubricating fluid may include one or more dispersants. The dispersants may be ashless dispersants having a polar group attached to a relatively high molecular weight hydrocarbon chain. Examples of such dispersants are N-substituted long chain alkenyl succinimides, succinic ester dispersants, succinic ester-amide dispersants, Mannich base dispersants, polymeric polyamine dispersants, phosphorylated forms thereof, and boronated forms thereof. The dispersants may be capped with acidic molecules capable of reacting with secondary amino groups.

The N-substituted long chain alkenyl succinimide may include polyisobutylene (PIB) substituents with a number average molecular weight of the polyisobutylene substituent in a range of about 500 to 5000. The PIB substituent used in the dispersant also has a viscosity at 100° C. of about 2100 to about 2700 cSt as determined by ASTM D445.

The polyisobutylene moiety in the dispersant preferably has a narrow molecular weight distribution (MWD), also referred to as polydispersity, as determined by the ratio of weight average molecular weight (Mw) to number average molecular weight (Mn). Polymers having a Mw/Mn of less than 2.2, preferably less than 2.0, are most desirable. Suitable polyisobutylene substituents have a polydispersity of from about 1.5 to 2.1, or from about 1.6 to about 1.8.

The dicarboxylic acid or anhydride of may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of acid or anhydride to hydrocarbyl moiety is from 1:1 to less than 1.6:1. Another useful molar ratio of dicarboxylic acid or anhydride to hydrocarbyl moiety is 1.3:1 to 1.7:1, or 1.3:1 to 1.6:1, or 1.3:1 to 1.5:1.

Any of numerous polyalkylene polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3.0:1.

The Mannich base dispersants may be a reaction product of an alkyl phenol, typically having a long chain alkyl substituent on the ring, with one or more aliphatic aldehydes containing from about 1 to about 7 carbon atoms (especially formaldehyde and derivatives thereof), and polyamines (especially polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

The dispersants described herein may be borated and/or phosphorylated. This type of dispersant is generally the reaction products of i) at least one phosphorus compound and/or a boron compound and ii) at least one ashless dispersant.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants described herein may include mixtures of one or more boronated and phosphorylated dispersants set forth above combined with non-boronated and non-phosphorylated dispersants.

If used, treat rates of the dispersants described above are provided in about 1 to about 5 weight percent and, in other approaches, about 1 to about 3 weight percent, and in yet other approaches, about 1 to about 2 weight percent in the lubricant.

Antifoam Agents: Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating fluid may be up 0.1 wt, or up to 0.08 wt %, or below 0.07 wt % based on the total weight of the lubricating fluid.

Seal-Swell Agents: The fluids of the present disclosure may further include seal swell agents. Seal swell agents such as esters, adipates, sebacates, azealates, phthalates, sulfones, alcohols, alkylbenzenes, substituted sulfolanes, aromatics, or mineral oils cause swelling of elastomeric materials used as seals in various engines, motors, and transmissions.

Alcohol-type seal swell agents are generally low volatility linear alkyl alcohols, such as decyl alcohol, tridecyl alcohol and tetradecyl alcohol. Alkylbenzenes useful as seal swell agents include dodecylbenzenes, tetradecylbenzenes, dinonyl-benzenes, di(2-ethylhexyl)benzene, and the like. Substituted sulfolanes (e.g. those described in U.S. Pat. No. 4,029,588, incorporated herein by reference) are likewise useful as seal swell agents in compositions according to the present invention. Mineral oils useful as seal swell agents in the present disclosure include low viscosity mineral oils with high naphthenic or aromatic content.

Pour-Point Depressants: The lubricants described herein may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from about 0.001 wt % to about 0.04 wt %, based upon the total weight of the lubricant.

In general terms, a durable lubricating fluid described herein for electric or hybrid-electric motors applications may include additive components in the ranges listed in Table 2.

TABLE 2

| Durable lubricating fluid | | |
|---|---|---|
| Component | Wt % (Suitable Embodiments) | Wt % (Preferred Embodiments) |
| Thiadiazole or derivative thereof | 0.5-1 | 0.7-0.9 |
| Amine Salt of Phosphoric Acid | 0.1-0.5 | 0.25-0.5 |
| Friction Modifier | 0-1 | 0.005-0.5 |
| Detergents | 0-0.5 | 0.005-0..3 |
| Antioxidants | 0-2 | 0.005-1 |
| Corrosion and Rust inhibitors | 0.1-3 | 0.5-1 |
| Additional Antiwear agents | 0-0.5 | 0-0.3 |
| Seal Swell agents | 0-0.1 | 0-0.05 |
| Extreme Pressure agents | 0-1 | 0-0.5 |
| Antifoaming agents | 0-0.1 | 0.005-0.05 |
| Viscosity index improvers | 0-5 | 1-4 |
| Base oil(s) | Balance | Balance |
| Total | 100 | 100 |

The percentages of each component above represent the weight percent of each component, based upon the total weight of the lubricating fluid containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

EXAMPLES

The following non-limiting examples illustrate the features and advantages of one or more embodiments of the disclosure. Unless noted otherwise or apparent from the context of discussion, all percentages, ratios, and parts noted in the examples and throughout this disclosure are by weight.

To demonstrate how the select fluids herein exhibited desired conductivity, exemplary finished fluids were formulated, aged, and evaluated.

In the examples below, several formulations were blended. For each formulation, a first lubricant sample was taken and an initial electrical conductivity was measured according to ASTM D2624-15 (modified to test a lubricant rather than a fuel), using an Epsilon+electrical conductivity meter (Flucon Fluid Control GmbH) or equivalent meter, at 1.5 volts, 20 Hz, and at 160° C. to obtain at least one conductivity reading. Then a second lubricant sample was taken from each formulation and was aged according to CEC L-48-A-00 at 170° C. for 192 hours. After aging, the fluids were allowed to cool to room temperature. After cooling, the conductivity of each aged fluid was measured according to ASTM D2624-15 (modified to test a lubricant rather than a fuel), using an Epsilon+electrical conductivity meter (Flucon Fluid Control GmbH) or equivalent meter, at 1.5 volts, 20 Hz, and at 160° C. to obtain at least one conductivity reading for each aged fluid being evaluated.

Example 1

The formulations tested in Table 3 below all contained the same base additive package containing friction modifier, detergent, antioxidant, phosphorylated and borated dispersant, corrosion inhibitor, and process oil. In addition to the base additive package, the formulations contained additional additives noted in Table 3. The formulations had small variations in the process oil treat rate, ranging from about 1.75 to about 0.43 weight percent of the finished fluid depending on the amounts of the thiadiazole or derivative thereof and/or phosphoric acid amine salt included in the formulation. The formulations had a total additive treat rate of about 5 to about 5.5 weight percent and included similar base oils and viscosity modifier to achieve kinematic viscosities at 100° C. of between about 4.9 and 5.9 cSt.

The additives of Table 3 were evaluated for initial and aged conductivity in order to determine electrical conductivity durability, or the ability of the fluid to maintain a relatively low electrical conductivity after aging. A low conductivity durability is desired, which means the fluid maintains conductivity performance upon aging. Table 3 reports the weight percent of the thiadiazole and phosphoric amine salt in the finished fluid, which also includes the additive package and base oil as reported above. Total sulfur, phosphorus, and nitrogen as well as the noted ratio are calculated based on amounts of such elements provided by the various components in the finished fluid. Conductivity results are provided in Table 4.

TABLE 3

| Relevant Fluid Details | | | | | | | |
|---|---|---|---|---|---|---|---|
| | C1 | C2 | C3 | Inv1 | Inv2 | Inv3 | Inv4 |
| Base Additive Package | 2.68 | 2.68 | 2.68 | 2.68 | 2.68 | 2.68 | 2.68 |
| Thiadiazole[1] | 0.35 | 0.35 | 0.35 | 0.85 | 0.7 | 0.85 | 0.85 |
| Amine Salt of Phosphoric Acid Ester[2] | — | 0.3 | 0.3 | 0.3 | 0.3 | 0.3 | 0.3 |
| Methyl hydrogen octadecyl phosphonate | 0.02 | 0.015 | — | — | — | — | — |
| Alkylated Naphthalene | — | 0.03 | — | — | — | — | — |
| Dispersant[3] | — | 1.0 | 1.0 | — | 1.0 | — | — |
| Phenolic Antioxidant[4] | 0.2 | 0.2 | 0.2 | 0.2 | 0.2 | 0.5 | 0.4 |
| Total Additive Treat Rate | 5 | 5 | 5 | 5 | 5.5 | 5.3 | 5.2 |
| Total sulfur | 1240 | 1240 | 1240 | 2990 | 2470 | 2990 | 2990 |
| Total Phosphorus | 70 | 290 | 280 | 200 | 280 | 200 | 200 |
| Total nitrogen | 660 | 910 | 910 | 1060 | 1140 | 1060 | 1060 |
| (S + P)/N Ratio | 2.0 | 1.7 | 1.7 | 3.0 | 2.4 | 3.0 | 3.0 |

[1]Thiadiazole: 85:15 mixture of 2,5-bis-(hydrocarbyldithio)-1,3,4-thiadiazole and 5-hydrocarbyldithio-2-mercapto-1,3,4-thiadiazole wherein the hydrocarbyl groups are C8 to C12 alkyl groups. This sulfur source includes about 35 weight percent sulfur and about 6.4 weight percent nitrogen.

[2]Amine Salt of a Phosphoric Acid Ester: mixture of dihexyl and monohexyl phosphate with di and/or trialkylated amines having alkyl groups of C12 to C14. This phosphorus source includes about 2.5 weight percent nitrogen and about 4.9 weight percent phosphorus.

[3]Borated and phosphorylated succinimide dispersant derived from 950 Mn polyisobutylene and having 0.35 weight percent boron and 0.76 weight percent phosphorus

[4]2,6-di-tertiary butyl phenol

TABLE 4

| Conductivity Results | | | |
|---|---|---|---|
| Sample | Initial Conductivity 160° C., pS/m | Conductivity after Aging 160° C., pS/m | Durability (Difference beween Conductivity after Aging and Initial Conductivity) |
| C1 | 29516 | 185603 | 156087 |
| C2 | 121807 | 538642 | 416835 |
| C3 | 124516 | 349876 | 225360 |
| Inv1 | 67157 | 65907 | 1250 |
| Inv2 | 133960 | 166246 | 32287 |
| Inv3 | 65517 | 59964 | 5553 |
| Inv4 | 64848 | 69848 | 5001 |

As shown in FIG. 1, the impact of the total fluid sulfur and phosphorus relative to the total nitrogen on the conductivity durability of the fluid (i.e., absolute value of the initial conductivity at 160° C. compared to the aged conductivity at 160° C.) is substantially improved for inventive samples that have a ratio of 2.3 or better and at least about 0.7 weight percent of the thiadiazole in the fluid. This result is surprising at such levels of fluid total sulfur and phosphorus given that these elements tend to be conductive. Moreover, given the low molecular weight of the thiadiazole, it would have been expected the conductivity of the fluids would have been unacceptably high after aging.

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A durable lubricating composition for electric or hybrid-electric vehicles, the lubricating composition comprising:

a base oil of lubricating viscosity;

at least about 0.7 weight percent of a thiadiazole or derivative thereof, an amine salt of a phosphoric acid ester providing at least about 100 ppm of phosphorus to the durable lubricating composition;

a sulfur plus phosphorus to nitrogen ((S+P)/N) weight ratio of at least 2.3;

the lubricating composition having at least about 150 ppm of phosphorus and at least about 2000 ppm of sulfur; and a conductivity durability of about 50,000 pS/m or less.

2. The durable lubricating composition for electric or hybrid-electric vehicles of claim 1, wherein the thiadiazole is selected from a mono hydrocarbyl thiol-substituted thiadiazole, a bishydrocarbyl thiol-substituted thiadiazole, or combinations thereof.

3. The durable lubricating composition for electric or hybrid-electric vehicles of claim 1, wherein the thiadiazole is 1,3,4-thiadiazole or derivative thereof.

4. The durable lubricating composition for electric or hybrid-electric vehicles of claim 1, wherein the thiadiazole provides at least about 2000 ppm sulfur to the durable lubricating composition.

5. The durable lubricating composition for electric or hybrid-electric vehicles of claim 4, wherein the durable lubricating composition includes up to about 3500 ppm total sulfur and up to about 300 ppm total phosphorus.

6. The durable lubricating composition for electric or hybrid-electric vehicles of claim 1, wherein the lubricating composition includes about 1 weight percent or less of the thiadiazole or derivative thereof.

7. The durable lubricating composition for electric or hybrid-electric vehicles of claim 1, wherein the thiadiazole or derivative thereof includes one or more compounds having a structure of Formula I:

(Formula I)

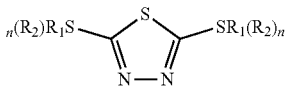

wherein

Each $R_1$ is independently hydrogen or sulfur;

Each $R_2$ is independently an alkyl group;

n is an integer of 0 or 1 and if $R_1$ is hydrogen then the integer n of the adjacent $R_2$ moiety is 0 and if $R_1$ is sulfur then the n of the adjacent $R_2$ moiety is 1; and wherein at least one $R_1$ is sulfur.

8. The durable lubricating composition for electric or hybrid-electric vehicles of claim 1, wherein the amine salt of a phosphoric acid ester includes one or more of a monoalkyl phosphoric acid ester and/or a dialkyl phosphoric acid esters and wherein the alkyl groups thereof may be linear or branched.

9. The durable lubricating composition for electric or hybrid-electric vehicles of claim 7, wherein the amine salt of a phosphoric acid ester is represented by Formula II (Formula II)

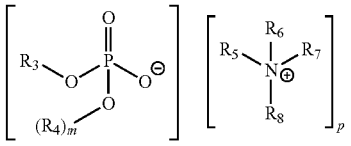

wherein $R_3$ and $R_4$ may be independently hydrogen or a linear, branched, or cyclic hydrocarbyl group;

m is an integer from 0 to 1, p is an integer from 1 to 2, and m+p equals 2;

$R_5$, $R_6$, $R_7$ and $R_8$ may be independently hydrogen or a hydrocarbyl group and at least one of $R_5$ to $R_8$ is a hydrocarbyl group.

10. The durable lubricating composition for electric or hybrid-electric vehicles of claim 9, wherein $R_3$ and $R_4$ may independently be a C3 to C10 alkyl group.

11. The durable lubricating composition for electric or hybrid-electric vehicles of claim 10, wherein at least one of $R_5$, $R_6$, $R_7$ and $R_8$ is C10 to C20 alkyl group.

12. The durable lubricating composition for electric or hybrid-electric vehicles of claim 10, wherein two of $R_5$, $R_6$, $R_7$ and $R_8$ are independently a C10 to C20 alkyl group.

13. The durable lubricating composition for electric or hybrid-electric vehicles of claim 1, wherein the amine salt of a phosphoric acid ester provides about 40 to about 90 weight % of the total phosphorus in the durable lubricating composition.

14. The durable lubricating composition for electric or hybrid-electric vehicles of claim 13, wherein the thiadiazole or derivative thereof provides at least about 99 weight % of the total sulfur in the durable lubricating composition.

15. The durable lubricating composition fur electric or hybrid-electric vehicles of claim 1, wherein the lubricating composition includes about 0.25 to about 0.5 weight percent of the amine salt of a phosphoric acid ester.

16. The durable lubricating composition for electric or hybrid-electric vehicles of claim 1, wherein the lubricating composition has an initial conductivity before aging of about 150,000 or less when measured according to ASTM D2624-15 at 1.5 volts, 20 Hz, and at 160 C.

17. The durable lubricating composition for electric or hybrid-electric vehicles of claim 1, wherein the conductivity durability is the difference between an initial conductivity and a final conductivity, and the initial and final conductivities are measured according to ATSM D2624-15 at 1.5 volts, 20 Hz, and at 160 C, and wherein the final conductivity is measured after the lubricating composition has been aged according to CEC L-48-A-00 at 170° C. for 192 hours.

* * * * *